US005626004A

United States Patent [19]

Gates et al.

[11] Patent Number: 5,626,004

[45] Date of Patent: May 6, 1997

[54] BAGGING MACHINE AND METHOD

[75] Inventors: Anthony H. Gates, Atwater; James P. Peppard, Euclid, both of Ohio

[73] Assignee: Automated Packaging Systems, Inc., Streetsboro, Ohio

[21] Appl. No.: 373,107

[22] Filed: Jan. 17, 1995

[51] Int. Cl.[6] ..... B65B 43/36; B65B 43/42; B65B 61/00

[52] U.S. Cl. ..... 53/459; 53/469; 53/202; 53/570; 53/284.7; 53/385.1; 53/389.2; 141/114

[58] Field of Search ..... 53/459, 202, 570, 53/385.1, 469, 284.7, 389.2; 141/114

[56] References Cited

U.S. PATENT DOCUMENTS

| | | | |
|---|---|---|---|
| Re. 32,963 | 6/1989 | Lerner et al. . | |
| 3,934,388 | 1/1976 | Stadlbauer et al. | 53/459 |
| 3,956,866 | 5/1976 | Lattur | 53/459 |
| 4,014,154 | 3/1977 | Lerner | 53/459 |
| 4,202,153 | 5/1980 | Lerner et al. . | |
| 4,269,016 | 5/1981 | Kopp et al. | 53/202 X |
| 4,899,520 | 2/1990 | Lerner et al. | 53/202 X |
| 5,077,958 | 1/1992 | Peppard et al. . | |
| 5,259,172 | 11/1993 | Peppard et al. . | |
| 5,485,714 | 1/1996 | Montalvo | 53/459 |

FOREIGN PATENT DOCUMENTS

| | | |
|---|---|---|
| 746658 | 3/1956 | United Kingdom . |
| 1588512 | 4/1981 | United Kingdom . |

OTHER PUBLICATIONS

EPO Pub. 547754A3 (Appln. 92310205.7, Nov. 6, 1992).
EPO Pub. 586201A1 (Appln. 93306802.5, Aug. 26, 1993).

*Primary Examiner*—Horace M. Culver
*Attorney, Agent, or Firm*—Watts, Hoffmann, Fisher & Heinke Co., L.P.A

[57] ABSTRACT

A bagging machine is disclosed having a frame including an upright section in the shape of an inverted "Y" mounted on the base and forming a forward part of the frame, a generally horizontal "Y" shaped section extending rearwardly from the upright section and, supports interposed between the base and the horizontal section. The frame defines a pair of web supply stations and supports a mirror image pair of load station assemblies each positioned to receive webs from an associated supply station. Each of the assemblies includes a backing plate and an air knife for delivering air to establish an air film between the plate and a web. An accumulator diverter is disclosed having an inlet and a pair of outlets each positioned above a respectively associated one of the load stations. The disclosure further includes a conveyor for supplying products to the diverter and the conveyer and diverter including coacting means to establish a time delay between the supply of one product and the supply of a successive product. An imprinter support and a fluid tight imprinter enclosure are also disclosed as are methods of operation.

48 Claims, 5 Drawing Sheets

BAGGING MACHINE AND METHOD

FIELD OF THE INVENTION

This invention relates to bagging machines and methods and more particularly to methods and apparatus which are especially suited for bagging foodstuffs.

BACKGROUND OF THE INVENTION

Batches of otherwise essentially bulk foodstuffs are frequently placed in plastic bags for transportation and storage. As an example, the machine described and claimed in U.S. Pat. No. 32,963 entitled Packaging Apparatus and Method, issued Mar. 24, 1987 and assigned to the assignee of this patent, (here the Chicken Machine Patent), has had wide acceptance for bagging parts of cut up chickens for transportation to, and storage at, fast food chicken restaurants. The machine of the Chicken Machine Patent has also enjoyed commercial success for packaging bulk quantities of such products as candy and dog food when used in combination with the shuttle and seal mechanism described and claimed in the same assignee's Patent No. 5,077,958, entitled Packaging Machine and Method, issued Jan. 7, 1992, (here the Bulk Packager Patent). The machine has also been used successfully in combination with an improved version of the Bulk Packager as taught and claimed in commonly owned Patent No. 5,259,172, issued Nov. 9, 1993, entitled Packaging Machine and Method, (here the Briquetting Patent). With the machine of the Briquetting Patent bulk foodstuffs such as lettuce are packaged after the bag has been compacted to expel air and compress the package contents.

While the bagging machine of the referenced patents, all of which are hereby incorporated by reference in their entireties, has enjoyed commercial success, it has its limitations. First and foremost it is relatively complex and therefor expensive. Secondly its cycle rate is relatively slow, such that it is unsuited for truly high volume chicken and other foodstuff processing facilities. Because of its relatively slow cycle rate, when used with a supply conveyor, the conveyor must operate intermittently to avoid mixing one product batch with the next. When product batches are mixed, one can, for example with a ten piece chicken cut-up, end up with eleven chicken parts in one bag and nine in the next. Moreover, even if but ten parts are in a given bag, there may be parts from two chickens, such that, for example, one bag has three legs and perhaps the next bag has but one leg and three wings. Since many chicken processing plants operate with continuous conveyor feed of chicken parts to handle the throughput of a chicken processing line, the Chicken Bagger is not susceptible to satisfactory use in such a processing plant.

With the machine of the referenced patents, webs of preopened interconnected bags are used. The bags are open at the front and interconnected along the back. As a consequence an end bag has a tendency to swing rearwardly, especially when it is loaded, but also as it is being fed along a path of travel to a load station. Accordingly, the machine is constructed such that components are positioned behind the loading station, which components provide resistance to bags swinging rearwardly. With some food products, such as chickens, these components become coated when in use with food substances such as chicken fat. Accordingly, provisions must be made to facilitate the feed of bags to the load station without sticking to the components. To that end, the machine of the Chicken Bagger patent utilizes a number of belts which have downwardly movable reaches that engage bags as they are being fed to the load station. These belts are referred to in the Chicken Bagger patent as O ring like belts. This belt arrangement is both unduly complex and difficult to clean and sterilize effectively as is necessary in a food processing environment.

Another limitation of the machine of the referenced patents is that foodstuffs being deposited in the bag are gravity fed into bags which are generally vertically oriented at the load station. While this is quite satisfactory for many foodstuffs, it is unsatisfactory, for example, for bagging a number of bagels delivered to the machine on a tray. Gravity feed of a quantity of such products is apt to damage the products.

Machines have been constructed in which products are inserted into horizontally supported bags. Others have provided for angular adjustment of the orientation of a bagging machine. However most prior machines have lacked the ability to position a load station assembly such that bags being loaded may be horizontally or vertically oriented or at selected orientations between the horizontal and the vertical.

Under regulations of the Food and Drug Administration, where two metal members abut, welds must be provided to avoid the presence of crevices where foodstuffs can collect. The obvious reason is that such collected foodstuffs can become an environment for germ cultures. Because of these regulations, machines of the referenced patents have welds which are not needed for structural integrity of the machine, but rather are provided only for the purpose of complying with FDA regulations.

In many applications it is desirable to imprint information about a product being packaged, the date of packaging and/or instructions as to its handling as a part of the machine bagging operation. The machine of the referenced patents is lacking in provision for the presence of such an imprinter and, should an imprinter be present, there is no provision for the protection of such an imprinter during a machine cleaning operation. As a consequence such information is often hand stamped on bags after loading.

Another shortcoming of the machine of the referenced patents is that its configuration is such that if conveyor fed, the conveyor often must be positioned as a side loader, rather than inline which militates against the provision of a linear path of food processing travel through a food processing facility.

SUMMARY OF THE INVENTION

With a machine made in accordance with this invention the shortcomings of the prior machine are overcome and other advantages are provided as well. With the improved machine substantially increased throughput is provided by a machine that is simpler to clean, simpler in construction and utilizable for a larger variety of products.

A generally "Y" shaped upright section is mounted at the forward part of a base. The upright section has an upstanding leg and two downwardly extending divergent arms which are fixed to the base. A generally horizontal "Y" shaped section has a leg fixed to the leg of the upright section and a pair of diverging arms extending rearwardly. Supports are interposed between the arms of the horizontal section and the base.

The upright section arms and the supports each have cutouts adjacent their lower ends which together with the base define triangular openings. These openings both facilitate cleaning and sterilization of the machine and avoid welds that are not needed for structural integrity but which, but for the cutouts, would be necessary to avoid crevices where foreign matter can collect.

The machine includes a pair of mirror image supply stations located behind the upright section and on either side of the leg of the horizontal section. Because the horizontal section is "Y" shaped with its leg between the supply stations, ready access to the supply stations is available to facilitate, for example, placing of cartons of bag webs in the supply stations and removal of empty cartons.

The load stations are defined by mirror image assemblies supported by the upright section on either side of its leg. Each of the load station assemblies is vertically adjustable and rotatably mounted on the upright section for selective positioning for loading bags in horizontal or vertical orientations or at any desired angular relationship between the horizontal and vertical. The load stations include mirror image pairs of web feed nip rolls. The nip rolls of each pair are counter rotatable for feeding a respective web from each pair's associated supply station to an associated load station.

Each of the load station assemblies includes a flat backing plate. An air knife is positioned near and downstream along the path of travel from the feed rolls. The air knife emits air as a web is being fed to establish a lubricating air film between the web and the plate. This air film maintains the web in spaced relationship with the plate thus providing the feed assist function of the O ring belts of the prior machine with a simplified machine that is more readily cleaned and sterilized.

A product receiver in the form of an accumulator/diverter is mounted above and in front of the leg of the upstanding section. The diverter has a top opening inlet and a laterally spaced pair of outlets each oriented for gravity delivery of products to be bagged to an associated one of the load stations. The diverter is configured to receive the discharge end of an inline conveyor. The "Y" shaped configuration of the horizontal section facilitates a semi-nested orientation of such a conveyor, facilitating an inline flow path of the product being packaged. Such a flow path is especially facilitated if the bagging machine of this invention is used in conjunction with either of the transporting and sealing structures taught and claimed in the Bulk Packager and Briquetting Patents.

One of the features of the present machine is provision for operation with a continuously operating supply conveyor while coacting with that conveyor to establish and maintain spacing between successive product quantities to be bagged. The spacing is achieved through utilization of a belt or chain conveyor of the type that has dividers or separators delineating individual product receiving spaces. A baffle, which is preferably curved, is carried by and forms a part of the diverter. The baffle is positioned near the inlet opening. The conveyor and machine are positioned such that the separators and the baffle coact to prevent a successive product being dropped into the diverter until a preceding product has been discharged into a bag positioned at one of the load stations.

Another feature of the diverter is that it has two internal discharge doors. Each of the doors is positioned to enable an accumulated product in the accumulator/diverter to escape through an associated one of the discharge openings and thence drop into a bag positioned at an associated one of the bag end stations. The doors are alternately opened such that products are discharged into the bagger at one station and then the other as bags are alternately positioned at their respective load stations for receiving products to be bagged.

Another unique feature of the machine of this invention is the provision of supports for programmable imprinters above the supply stations. The imprinters are selectively utilizable to permit print information on the bags, such as identification of a product in a bag, date of packaging, and instructions for use.

A printer enclosure is supported by the frame at a location rearwardly of the supply stations. The enclosure has doors at its opposite ends accessible from opposite sides of the machine. When the machine is to be cleaned and sterilized, the programmable imprinters are removed from their supports and placed within the enclosure. Once the doors of the enclosure are closed, the imprinters are within a fluid tight enveloping enclosure, so that the machine can be cleaned and sterilized without damage to the imprinters.

Accordingly the objects of the invention are to provide a novel and improved bagging machine for bagging portions of bulk materials, particularly foodstuffs, and a method of bagging such materials.

IN THE DRAWINGS

DESCRIPTION Of PREFERRED EMBODIMENT

Figure 1:
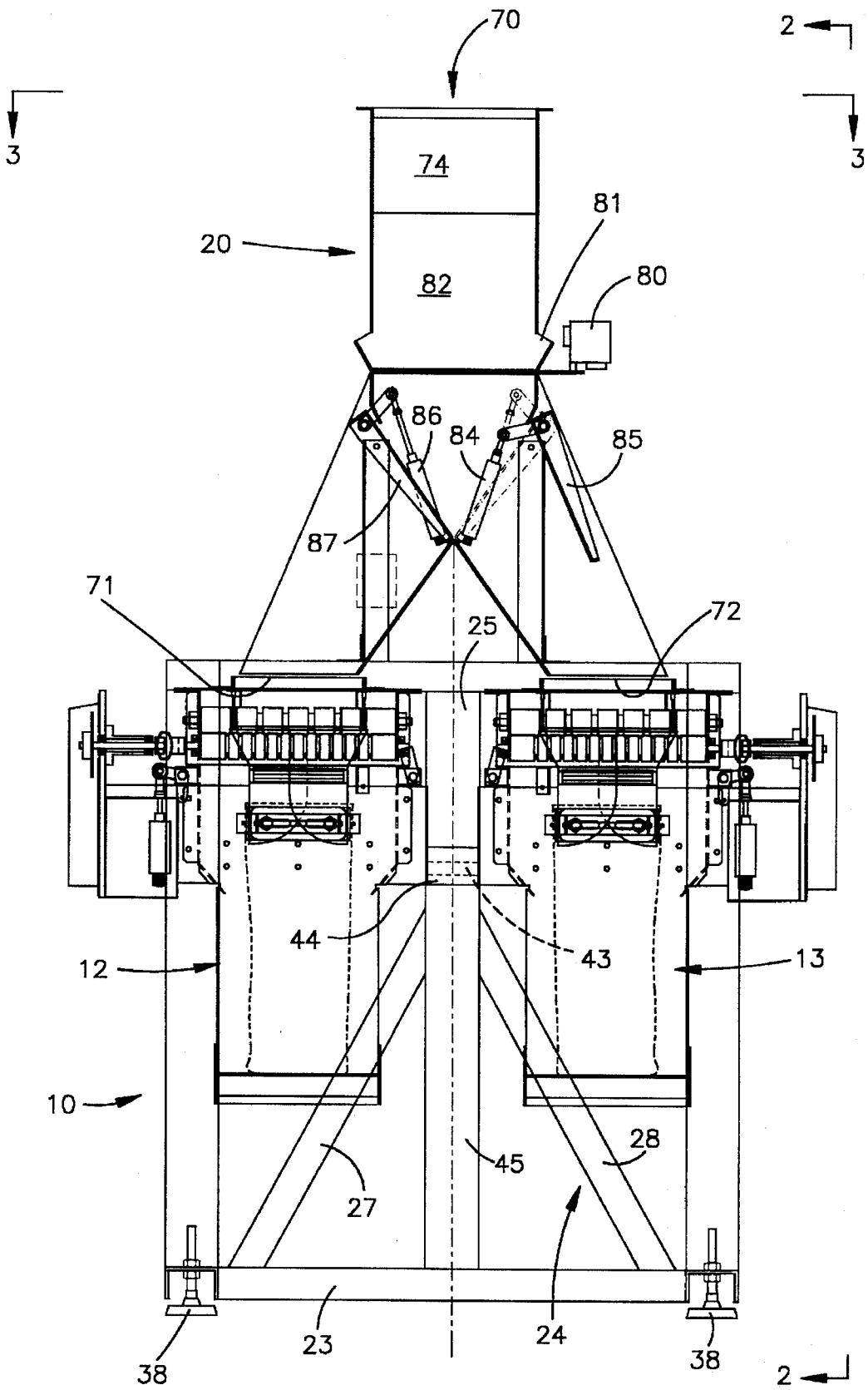
FIG. 1 is a front elevational view of the machine.
Figure 2:
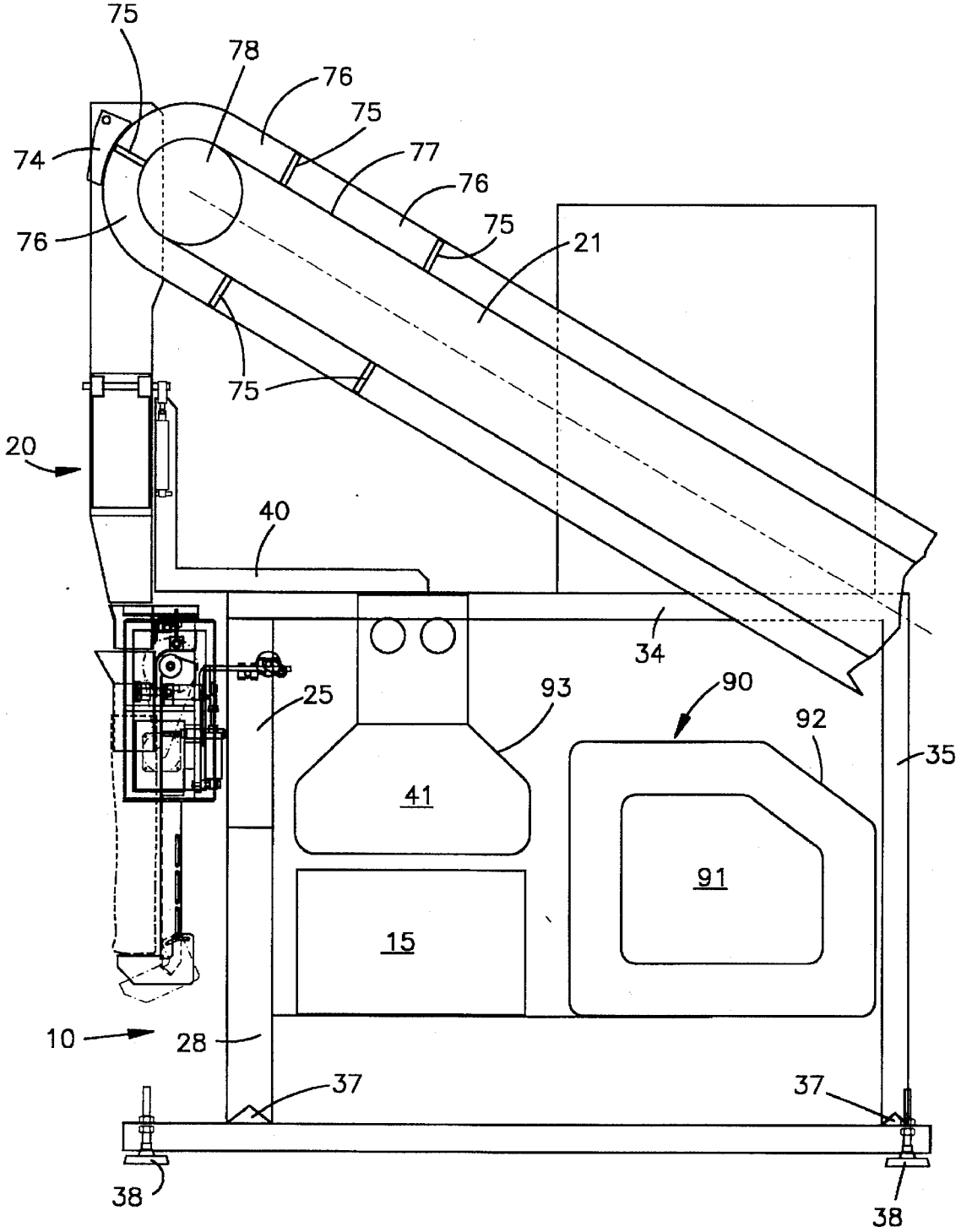
FIG. 2 is a side elevational view of the machine.
Figure 3:
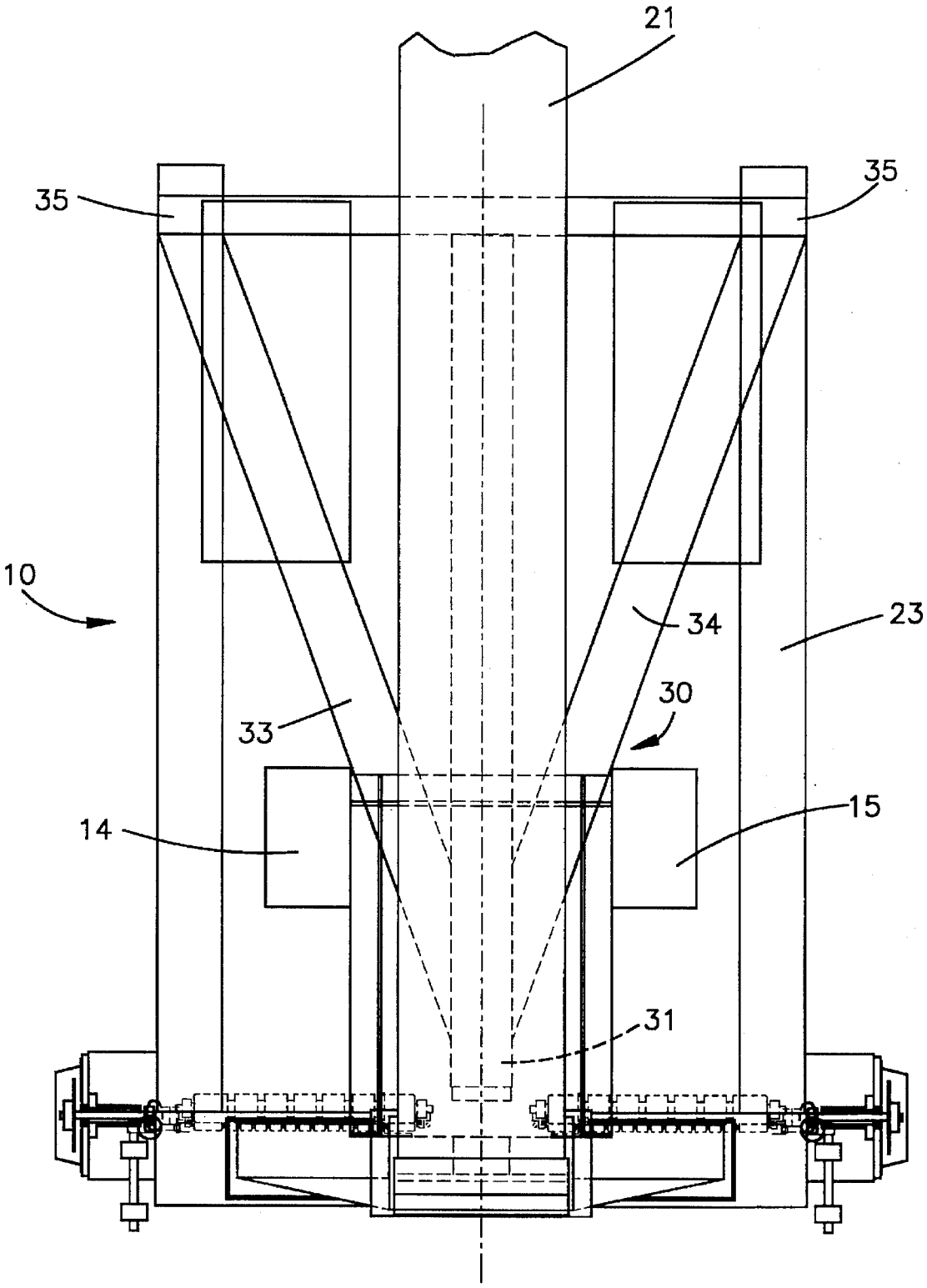
FIG. 3 is a top plan view of the machine.

Referring now to the drawings and to FIGS. 1–3 in particular, a packaging machine including the frame structure shown generally at 10 is provided. As is best understood by reference to FIGS. 1 and 3, the machine is a dual bagget having mirror image feed and load station assemblies 12, 13 supported by the frame 10. The frame delineates mirror image supply stations 14, 15, FIGS. 2 and 3.

In use, webs of interconnected, preopened bags 17 are fed along respective paths of travel indicated at 18, to respective load stations delineated by the assemblies 12, 13. An accumulator/diverter shown generally at 20 is positioned to receive products from a conveyor 21. The accumulator/diverter guides gravity fed products sequentially and alternately to bags positioned in the load station assemblies 12, 13.

The Frame Structure 10

The frame structure 10 includes a generally rectangular base 23. An upright section 24 is mounted on the forward, or left hand portion as viewed in FIG. 2, of the base 23. The upstanding section includes an upstanding post or leg 25 and a pair of downwardly diverging arms 27, 28 as are best seen in FIG. 1. Thus the upstanding section 24 is in the shape of an inverted "Y" having a leg 25 and diverging arms 27, 28.

A horizontal section shown generally at 30 projects rearwardly from the upstanding section 24. The horizontal section, is as is best seen in FIG. 3, in the shape of a truncated "Y" having a short leg portion 31 and rearwardly diverging arms 33, 34. The leg section 31 is connected to the leg 25 of the upstanding section, while the arms 33, 34 are connected to supports 35 which in turn are mounted on the base 23.

The provision of a truncated "Y" horizontal section 30 has several advantages. A first advantage is semi-triangulation for strength. A second advantage is that the supply stations 14, 15 are readily accessible because of the open clearance afforded through the use of the "Y" section. A third advantage is that the conveyor 21 is readily positioned close to the overall machine and in a partially nested relationship for the supply of products to be bagged to the accumulator/diverter 20.

An advantageous feature of the construction of the frame 10 is the provision of cut outs in lower portions of the arms 27, 28 of the upstanding section and at other places in the frame. These cut outs coact with the base 23 to delineate triangle openings, one of which is shown at 37 in FIG. 2. These openings both facilitate cleaning and sterilization of the machine, and also reduce costs because they obviate the need for a weld at each cut out location as would be required, but for the cut outs.

Since it is intended that the machine will usually be relatively, permanently positioned in a processing facility, but it is also anticipated that the floor of such a facility will not be perfectly level, leveling feet 38 are provided adjustably to support the machine.

A right angle support section 40 is mounted atop the upstanding section and the horizontal section. This support section 40 supports the accumulator/diverter 20. The support section also optionally supports a programmable imprinter 41 which is preferably of the type sold by the assignee under the designation PI-4000 and which is described in greater detail in copending application Ser. No. 08/090,896, filed on Jul. 12, 1993, under the title Web Imprinting Apparatus and Method.

The Feed and Load Station Assemblies 12, 13

In that the feed and load station assemblies 12, 13 are mirror images of one another, only the right hand, as viewed in FIG. 1, assembly 13, will be described in detail. The assemblies are mounted on a common shaft 43. The shaft in turn is rotatably mounted in a clamp 44. The clamp 44 permits rotative adjustment of the shaft 43 and the supported assemblies 12, 13 to a desired orientation anywhere in an adjustment range from the horizontal position shown in solid lines in FIGS. 1 and 2 to a vertical orientation. The clamp 44 in turn is connected to a channel 45 that depends from the upstanding section leg 25. The clamp 44, and with it the shaft 43 as well as the assemblies 12, 13, is adjustable to a desired height by selectively securing it at an appropriate height on the post 45.

The assembly 13 includes a pair of counter rotatable nip rolls 47, 48. A stepper feed motor 49 is drivingly connected to the nip roll 48 via a chain or cog belt 50. Rotation of the roll 48 in a counter clockwise direction as viewed in FIG. 5 will feed the web 17 along its path 18. Clockwise rotation of the roll 48 is used to retract the web for bag separation in a manner corresponding to that described and claimed in greater detail in the Chicken Bagger Patent.

Figure 4:
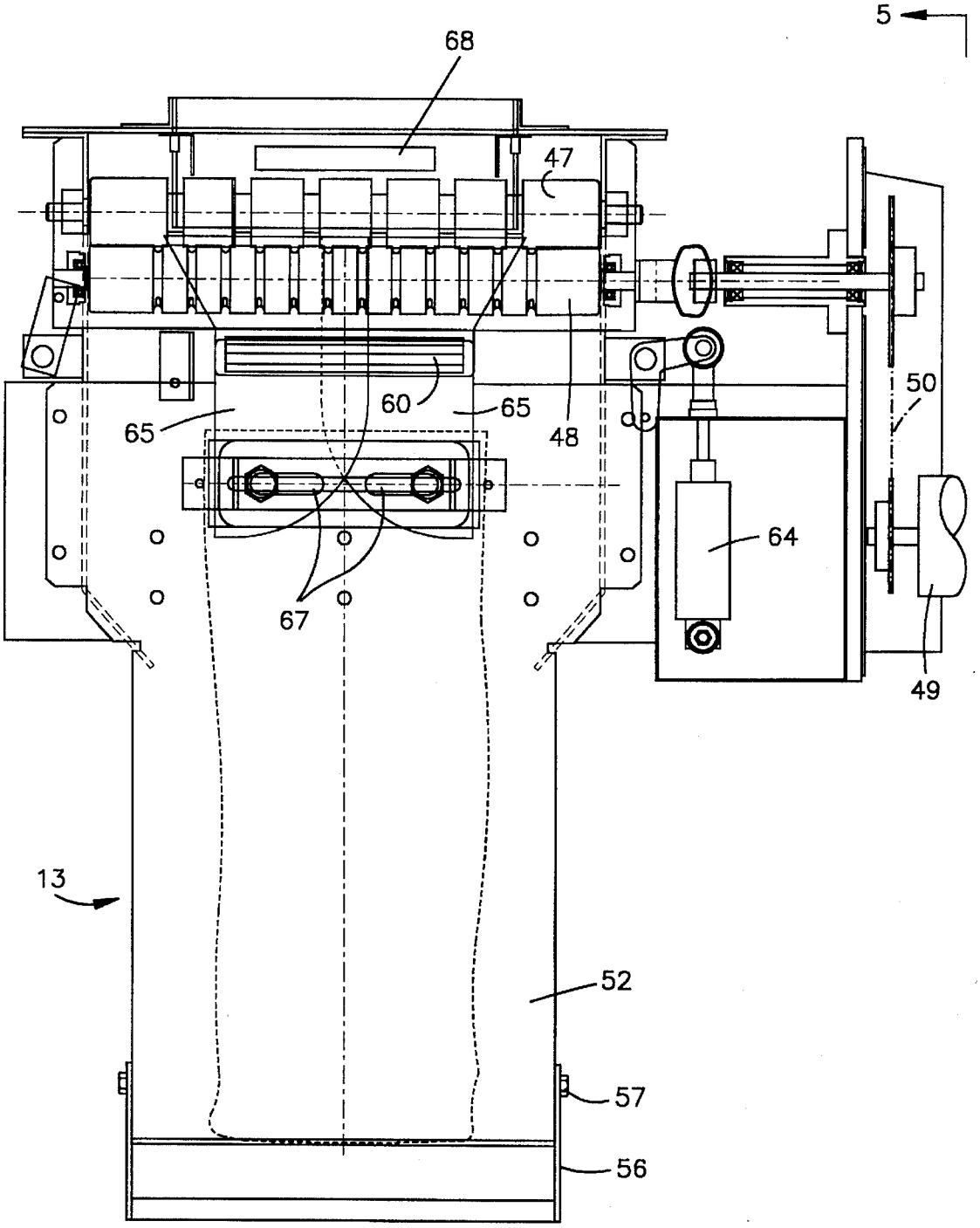
FIG. 4 is a front elevational view of a load station assembly on an enlarged scale with respect to FIGS. 1–3; and, FIG. 5 is a side elevational view of a load station assembly on the scale of FIG. 4.
Figure 5:
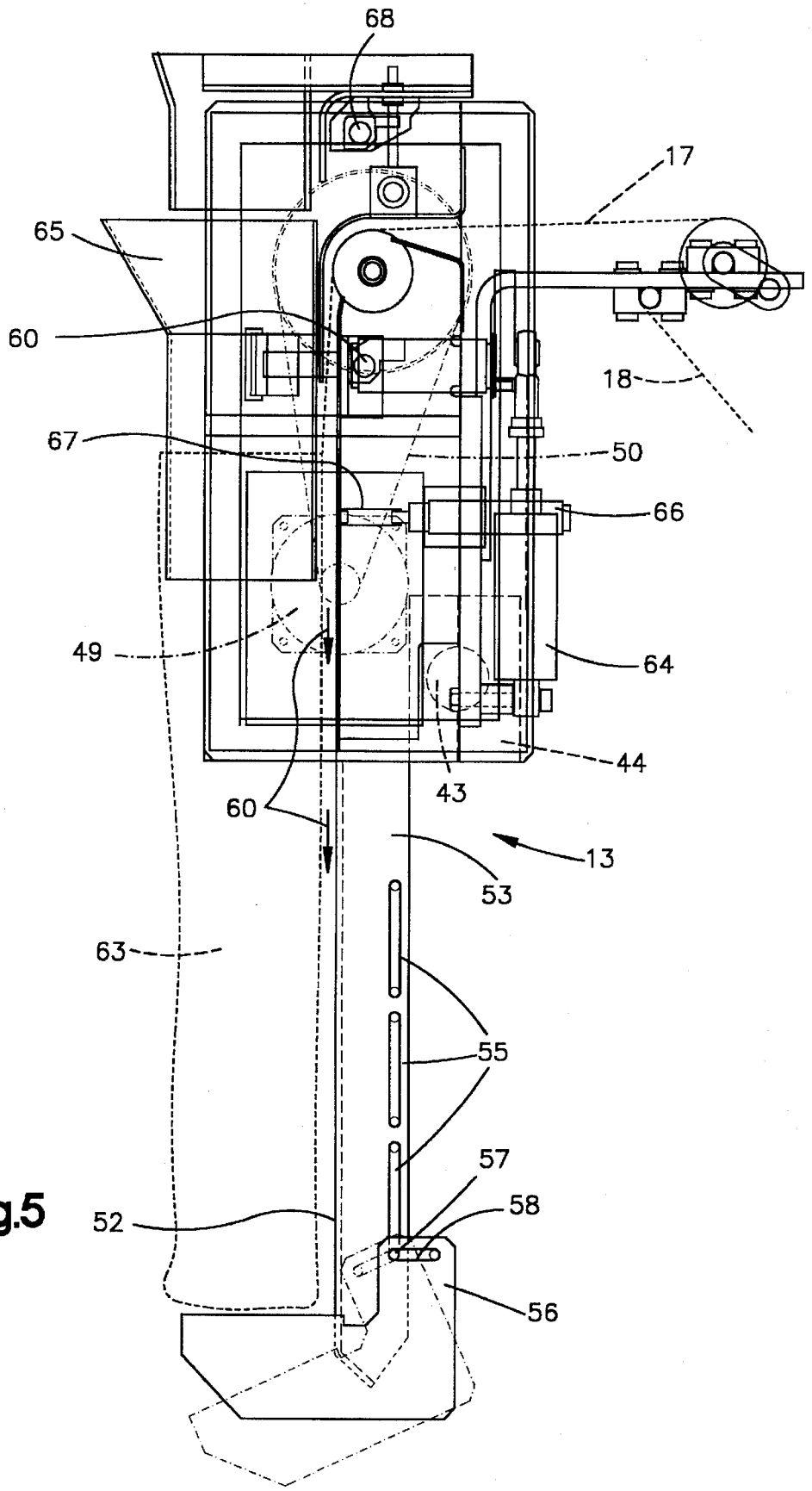

The assembly includes a depending air director plate 52. When the assembly 13 is in its horizontal position as shown in FIGS. 4 and 5, the plate 52 is vertical and immediately behind the path of bag travel. The plate 52 includes rearwardly extending flanges 53 which provide stiffening for the plate. In addition the flanges are slotted at 55. A bag support 56 is secured to the flanges 53 by fasteners 57 each of which extends through a selected one of the elongated slots 55. The bag supports are also slotted at 58 so that the bag support is both vertically adjustable relative to the plate 52 and adjustable fore and aft and angularly as indicated by phantom lines in FIG. 5.

An air knife 60 is secured to the plate 52 near its top as viewed in FIGS. 4 and 5. Thus with the assembly 13 in a vertical orientation the knife 60 is immediately below the nip roll 47, 48. The knife 60 is a commercially available knife sold under the trademark Exaire® by Exaire of Cincinnatti, Ohio as Model No. 2006SS.

As the web 17 is fed downwardly along its path of travel, air from the air knife 60 is directed downwardly, as indicated by arrows 61, to develop a film of air between the web and the plate 52. This film provides lubrication which avoids any tendency of the web being fed to stick to the plate 52 due to residue, static electricity or other causes.

Once an end bag 63, FIG. 5, is appropriately located along a path of travel a horn positioning cylinder 64 is actuated. The cylinder 64 shifts horns 65 to a bag opening position indicated in FIG. 5 in a manner corresponding to that described in greater detail in the reference Bulk Packager Patent. Once the horns are in their bag opening position, a clamp cylinder 66 is actuated to clamp retention pad 67 against the positioned bag. This clamping provides support for the bag 63 as a product is deposited in it and also resistance to bag movement for bag separation when the nip rolls are reversed to separate the bags in the manner described in greater detail in the referenced Chicken Bagger Patent.

A bag opening air knife 68 is positioned above the nip rolls to direct air downwardly against the bag 63 as it is brought into its loading position. Air from the bag opening knife 68 functions to sufficiently open the bag to permit the horn 65 to gain entry into the bag opening.

In operation, the web 17 is fed from the .supply station 15 upwardly along the path 18. The feed motor 49 is jogged to feed the web between the nip rolls 47, 48 and thus downwardly. The bag support is adjusted to its desired orientation and adjustments are made between a known web position detector, such as a spark gap detector, (not shown), to assure that the end bag 63 is appropriately orientated downstream from the nip rolls.

Once the machine is set up the feed motor 49 is energized to feed an end bag 63 to the load station. As the end bag is being fed, the air knife 60 is operating to create and maintain a film of air between the bag and the plate 52. Once feed is stopped the bag opening air knife 68 is operating to open the bag 63 and the horn cylinder 64 is then actuated to position the horns in the bag. Momentarily after the horns are positioned, the clamp cylinder 65 is actuated to clamp the bag against the horns. A product is then gravity fed, when the orientation of FIGS. 4 and 5 is employed, into the bag 63. The feed motor 49 is reversed to separate the now loaded bag from the web. The horn cylinder 64 is again energized to return the horns from their bag opening to their storage position and the loaded bag is removed from the machine. Thereafter the feed motor 49 is again energized to feed the web and the cycle is repeated.

The Accumulator/Diverter 20

The Accumulator/Diverter 20 has an upper inlet open 70 and a spaced pair of outlet openings 71, 72 respectively aligned with the load station assemblies 12, 13. The diverter 20 has a baffle 74 adjustably mounted in its top opening 70. The baffle 74 is preferably curved to coact with conveyor dividers or spacers 75. Successive ones of the divers 75 delineate product spaces 76. As a conveyor belt or chain 77 passes around an end drum 78 one of the dividers 75 coacts with the baffle 74 to retain a product in the succeeding product space 76 after a preceding product has been dropped into the accumulator/diverter 20. Thus, the baffle and the dividers function to provide spacing between successive product discharges from the conveyor into the accumulator/diverter.

The dropping of a product into the accumulator/diverter is sensed by an ultrasonic detector 80. A suitable detector 80 is sold by Hyde Park Superprox under the designation SM500. A product dropping through the diverter 20 is "seen" by the detector 80 via an access port 81 formed in the lower side of an input chute portion 82 of the diverter 20. A signal from the sensor 80 is transmitted to a control (not shown). Assuming the load station assembly 13 has an end bag 63 positioned to receive a product, the sensed product will be discharged through the discharge opening 72.

To accomplish product discharge, a discharge cylinder 84 is actuated to open a diverter door 85 to discharge the product in the diverter through the discharge opening 72. Concurrently, the load station assembly 12 will be operating during a different phase of its cycle to prepare an end bag 63 for receipt of the next product to be discharged from the diverter 20. When the sensor 80 has sensed the deliver of this next product, a discharge actuator 86 will open a diverter door 87 which is a mirror image of the door 85. Opening of the diverter door 87 discharges product through the discharge opening 71 to a positioned bag 63 in the load station assembly 12. This left/right cycle repeats repetitively as the operation of the load station assembly continues in a synchronized manner. In this manner the machine is able to bag products being delivered by a continually operating conveyor 21.

The Programmable Imprinter 41

Another of the features of the machine of the present invention relates to programmable imprinters. While the present machine must be capable to withstand cleaning and sterilization, the imprinters are not. Accordingly, a printer enclosure 90 is provided (FIG. 2). When the machine is to be cleaned and sterilized, the imprinter 41 is disconnected from the support section 40. A door 91 of the enclosure 90 is opened and the imprinter is positioned within the enclosure. Once the door 91, and its mirror image equivalent on the opposite side of the enclosure, not shown, are fully closed, the enclosure provides a fluid tight storage chamber for the programmable imprinter 41 and its not shown mirror image counterpart from the other side of the machine.

A feature of the enclosure is a chamfered roof portion 92 which is available because the imprinter has a corresponding sloping chamfered portion 93. These chamfered portions further facilitate a semi nesting relationship between the novel bagging machine of this invention and the conveyor 21.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. In a bagging machine utilizing chains of interconnected preopened bags, an improved mechanism for positioning bags at a loading station comprising:

a) a feed structure for feeding the chain along a path of travel to position an end one of the bags at the load station;

b) a backing structure positioned adjacent the path of travel and the station; and, c) a pressurized air supply means connected to the structure and positioned below the path and upstream of the path from the station to direct air between the path and the structure into the station whereby to develop an air film between such end bag being fed to the loading station and the structure as the bag enters the station and while allowing the chain to remain in the path.

2. The machine of claim 1 wherein the backing structure is an imperforate plate.

3. The machine of claim 2 wherein the plate is adjustable over a range from a generally vertical orientation to a generally horizontal orientation and the supply means is an air knife positioned to develop such air film when the plate is in any position in the range.

4. The machine of claim 1 wherein the air supply means is a first air knife and a second air knife is provided on the opposite side of the path from the first air knife, the second knife being for opening bags at the loading station.

5. A bagging machine comprising:

a) a frame structure delineating bag supply and loading stations;

b) a pair of coacting feed rolls carried by the structure and positioned to feed a web of interconnected bags along a path of travel from the supply station to the loading station;

c) the machine having an air film providing means including:

i) an air knife carried by the structure and positioned along and behind the path downstream from the feed rolls; and, ii) a portion of the structure forming an air flow director;

iii) the air knife being oriented to direct a flow of air downstream of the path between the path and the director whereby to cause a film of air to be developed between the director and a bag as such bag is fed along the path into the loading station; and d) a bag opening mechanism for sequentially opening bags at the load station.

6. The machine of claim 5 wherein the portion is a plate.

7. In a bagging machine utilizing chains of interconnected preopened bags, an improved mechanism for positioning bags at a loading station comprising:

a) a backing structure positioned adjacent a bag path of travel;

b) a pressurized air supply means connected to the structure and positioned to direct air between the path and the structure whereby to develop an air film between a bag being fed to the loading station and the structure; and, c) the load station being delineated by an assembly which is adjustably carried by the frame structure for providing a range of orientations for bags positioned at the load station.

8. The machine of claim 7 wherein the range is from a substantially horizontal to a substantially vertical orientation.

9. The machine of claim 7 wherein the assembly is vertically adjustably carried by the structure.

10. A bagging machine comprising:

a) a frame structure delineating spaced pairs of bag supply and loading stations;

b) spaced pairs of coacting feed roll sets carried by the structure and positioned to feed webs of interconnected bags along respective paths of travel each from an associated one of the supply stations to the paired loading station;

c) the machine having air film providing means including:

i) a spaced pair of air knives carried by the structure and each positioned along and behind an associated one of the paths downstream from the roll sets; and, ii) portions of the structure forming air flow directors;

iii) the air knives being oriented to direct a flow of air downstream of the path between the path and the directors whereby to cause films of air to be developed between each director and bags as such bags fed along their paths into the loading stations; and d) a pair of bag opening mechanisms respectively for sequentially opening bags at respective ones of the load stations.

11. The machine of claim 10 wherein the portions are plates.

12. A bagging machine comprising:

a frame structure delineating spaced pairs of bag supply and loading stations;

b) spaced pairs of coacting feed roll sets carried by the structure and positioned to feed webs of interconnected bags along respective paths of travel each from an associated one of the supply stations to the paired loading station;

c) the machine having air film providing means including:

i) a spaced pair of air knives carried by the structure and each positioned along an associated one of the paths downstream from the roll sets; and, ii) portions of the structure forming air flow directors;

iii) whereby to cause films of air to be developed between each portion and bags as such bags fed along their paths;

d) a pair of bag opening mechanisms respectively for sequentially opening bags at respective ones of the load stations; and, e) the load stations being delineated by a pair of assemblies which are adjustably carried by the frame structure for providing a range of orientations for bags positioned at the load stations.

13. The machine of claim 12 wherein the range is from a substantially horizontal to a substantially vertical orientation of each of the plates.

14. The machine of claim 12 wherein the assemblies are mirror image assemblies.

15. A bagging machine comprising:

a) a frame structure delineating spaced pairs of bag supply and loading stations;

b) spaced pairs of coacting feed roll sets carried by the structure and positioned to feed webs of interconnected bags along respective paths of travel each from an associated one of the supply stations to the paired loading station;

c) the machine having air film providing means including:

i) a spaced pair of air knives carried by the structure and each positioned along an associated one of the paths downstream from the roll sets; and, ii) portions of the structure forming air flow directors;

iii) whereby to cause films of air to be developed between each portion and bags as such bags fed along their paths;

d) a pair of bag opening mechanisms respectively for sequentially opening bags at respective ones of the load stations; and, e) the structure including an imprinter support for supporting an imprinter for imprinting a web being fed along an associated one of the paths and a fluid tight imprinter enclosure for protectively housing such imprinter during machine cleaning.

16. The machine of claim 15 wherein there are a pair of imprinter supports each disposed along a different one of the paths of travel and the enclosure is adapted to protectively house a pair of imprinters.

17. A bagging machine comprising:

a) a frame including:

i) a base;

ii) an upright section in the shape of an inverted "Y" mounted on the base and forming a forward part of the frame, the upright section including an upstanding leg and downwardly extending and diverging arms fixed to the base;

iii) a generally horizontal "Y" shaped section having a leg fixed to the upright section and a pair of arms extending and diverging rearwardly; and, iv) supports interposed between the base and the horizontal section arms;

b) the frame defining a pair of web supply stations positioned behind the upright section and on either side of and below the horizontal section leg;

c) a pair of feed roll sets each for feeding a different one of a pair of webs of preopened bags from the respective supply stations along respective paths of travel to respective ones of a pair of load stations;

d) roll set support structure connected to the sets and to the upright section, the support structure positioning the sets on opposite sides of the upright section leg for respectively feeding webs along spaced paths of travel each from an associated one of the supply stations;

e) a pair of load station assemblies carried by the upright section each positioned to receive an associated one of such webs delivered along an associated one of the paths from a respectively associated one of the roll sets;

f) each of the assemblies including a backing plate and an air knife for delivering air to establish an air film between the plate and a web in an associated one of the paths of travel;

g) an accumulator diverter carried frame the diverter having an inlet and a pair of outlets, each of the outlets being positioned above a respectively associated one of the load stations; and, h) the diverter including an output control mechanism for selectively enabling discharge of a product to be packaged through a selected one of the outlets.

18. The machine of claim 17 wherein the load station assemblies are adjustably carried by the upright for providing a range of orientations for bags positioned at the load stations.

19. The machine of claim 18 wherein the range is from a substantially horizontal to a substantially vertical orientation of each of the plates.

20. The machine of claim 17 wherein the assemblies are vertically adjustably carried by the upright.

21. The machine of claim 17 further including a conveyor for supplying products to be packaged to the diverter and the conveyer and diverter including coatting means to establish a time delay between the supply of one product and the supply of a successive product.

22. The machine of claim 21 wherein the coacting means comprises conveyor separators delineating discrete product spaces each between a successive pair of separators and a coacting diverter baffle for coaction with the separators successively and one at a time.

23. The machine of claim 21 wherein the conveyor is disposed in part between the horizontal section arms.

24. The machine of claim 17 wherein the assemblies are mirror image assemblies.

25. The machine of claim 17 wherein the frame includes an imprinter support for supporting an imprinter for imprinting a web being fed along an associated one of the paths and a fluid tight imprinter enclosure for protectively housing such imprinter during machine cleaning.

26. The machine of claim 17 wherein the upright section arms include base portions, delineating base cut outs, the cut out base portions each coacting with the base to delineate an opening.

27. A process of positioning a bag at a load station of a bagging machine comprising:

a) feeding a bag along a path of travel from a supply to the load station; and, b) establishing a lubricating film of air between the bag and a section of the machine as the bag is fed along the path.

28. The process of claim 27 wherein an air knife is used to develop the film.

29. The process of claim 28 wherein the bag is opened at the load station by air supplied from a second air knife.

30. The process of claim 27 wherein a pair of powered feed rolls effect the feeding step and the air film is established along the path down stream from the feed rolls.

31. The process of claim 27 wherein the bag is one of a plurality of interconnected preopened bags.

32. A process of bagging products with a bagging machine comprising:

a) positioning a web of preopened interconnected bags between the rolls of a pair of opposed nip rolls forming a part of the machine;

b) counter rotating the rolls to feed the web of bags along a path from a supply station to a load station to position the bags sequentially and one at a time at the load station;

c) establishing a film of air between the web and the machine at a location along the path downstream from the nip rolls, the film being established as the web is fed;

d) periodically stopping the web feed as an end one of the bags is positioned at the load station;

e) while the feed is stopped inserting horns of a spaced pair of horns in the opening of the positioned bag and spreading the horns from a storage to a bag open position to open the positioned bag;

f) inserting a product into the positioned bag;

g) reversing the rolls to reverse the direction of web feed to rupture a line of weakness connecting the positioned bag from the web and thereby separate the positioned bag from the web;

h) returning the horns to their storage position after the product has been inserted in the positioned bag; and, i) repeating steps (b) through (h) inclusive.

33. The process of claim 32 wherein there are two such feed paths and load stations and the steps are sequentially performed along each path with the product insertion step being alternately performed at one load station and then the other.

34. A mechanism for spacing products for successive delivery to a work station comprising:

a) a conveyor having spaced separators delineating successive product receiving spaces;

b) a product receiver positioned successively to receive products delivered from the spaces; and, c) the receiver including baffle means for coacting with the separators sequentially and one at a time to prevent the discharge of products from such spaces during such coaction thereby to delay the discharge of each product from the conveyor following the discharge of a preceding product.

35. The mechanism of claim 34 wherein the baffle means includes an arcuately curved baffle positioned concentrically about an axis of conveyor end drum rotation.

36. In a bagging machine utilizing webs of plastic material sequentially fed along a path of travel from a supply station to a loading station, the improvement comprising:

a) frame structure for supporting an imprinter along the path for imprinting a web being fed;

b) a fluid tight enclosure carried by the structure; and, c) the enclosure including an access door to permit selective insertion and removal of an imprinter into and from a space within the enclosure.

37. In a bagging machine an improved frame comprising:

a) base;

b) an upright section in the shape of an inverted "Y" mounted on the base and forming a forward part of the frame, the upright section including an upstanding leg and downwardly extending and diverging arms fixed to the base;

c) a generally horizontal "Y" shaped section having a leg fixed to the upright section and a pair of arms extending and diverging rearwardly;

d) supports interposed between the base and the horizontal section arms; and, e) the frame defining a pair of web supply stations positioned behind the upright section and on either side of and below the horizontal section leg.

38. The frame of claim 37 wherein the upright section arms include base portion delineating base cut outs, the cut out portions each coacting with the base to delineate an opening.

39. A bagging machine comprising:

a) a frame structure delineating bag supply and loading stations;

b) a web feed mechanism carried by the structure and positioned to feed a web of interconnected bags along a path of travel from the supply station to the loading station sequentially to position end ones of the bags at the load station; and, c) an air film generator connected to the structure and positioned near but upstream of the path from the load station, the generator including:

i) an air knife carried by the structure and positioned along the path downstream from the feed mechanism;

ii) a portion of the structure forming an air flow director; and, iii) the knife being positioned to direct a flow of air downstream of the path between the path and the director whereby to cause a film of air to be developed between the director and a bag as such bag is fed along the path into a loading position at the load station.

40. The machine of claim 39 wherein the director is a plate.

41. The machine of claim 39 wherein the load station is delineated by an assembly which is adjustably carried by the frame structure for providing a range of orientations for bags positioned at the load stations.

42. A bagging machine comprising:

a) a frame structure delineating spaced pairs of bag supply and loading stations;

b) spaced feed mechanisms carried by the structure and positioned to feed webs of interconnected bags along respective paths of travel each from an associated one of the supply stations to the paired loading station sequentially to position end ones of the bags at the load stations; and, c) the machine having spaced air film generators respectively upstream of their respective paths from their respective load stations, the generators including:

i) a spaced pair of air knives carried by the structure and each positioned along an associated one of the paths downstream from the feed mechanisms;

ii) portions of the structure forming air flow directors; and, iii) the knives each being positioned to direct a flow of air downstream of the path between its respective path and director whereby to cause films of air to be developed between each director and bags as such bags fed along their respective paths into respective loading positions at the load stations.

43. The machine of claim 42 wherein the directors are plates.

44. The machine of claim 42 wherein the load stations are delineated by a pair of assemblies which are adjustably carried by the frame structure for providing a range of orientations for bags positioned at the load stations.

45. A process of bagging products with a bagging machine comprising:

a) feeding a web of preopened interconnected bags along a path from a supply station to a load station to position the bags sequentially and one at a time at the load station;

b) with a flow of air establishing a film of air between an end one of the bags and the machine at a location along the path downstream from the supply station, the film being established between such end bag and the machine as such end bag is fed into the load station;

c) periodically stopping the web feed as such end one of the bags is positioned at the load station;

d) while the feed is stopped inserting a product into the positioned bag;

e) separating the positioned bag from the web by rupturing a line of weakness connecting the positioned bag from the web; and, f) repeating steps (a) through (e) inclusive.

46. The process of claim 45 wherein there are two such paths and load stations and the steps are sequentially performed along each path with the product insertion step being alternately performed at one load station and then the other.

47. In a bagging machine an improved loading mechanism comprising:

a) a frame structure;

b) a load station assembly rotatably mounted on the structure and including bag handling means for moving a bag into and positioning such bag at a load station and opening the bag to receive a product;

c) the assembly being selectively positionable in a selected bag orientation in an orientation range from an essentially vertical orientation to an essentially horizontal orientation;

d) a clamp interposed between the structure and the assembly for fixing the assembly in any selected orientation in the range;

e) the assembly including a bag backing for supporting a positioned bag in at least certain of the orientations within the range; and, f) air film generating means supported by the frame structure and positioned for establishing a film of air between such bag and the backing as the bag is fed into the load station.

48. In a bagging machine utilizing chains of interconnected preopened bags, an improved mechanism for positioning bags at a loading station comprising:

a) a backing structure positioned adjacent a bag path of travel;

b) a pressurized air supply means connected to the structure and positioned to direct air between the path and the structure whereby to develop an air film between a bag being fed to the loading station and the structure; and, c) the frame structure including an imprinter support for supporting an imprinter for imprinting webs being fed along the path and a fluid tight imprinter enclosure for protectively housing such imprinter during machine cleaning.

* * * * *